US011738443B2

(12) United States Patent
Billups, Jr.

(10) Patent No.: US 11,738,443 B2
(45) Date of Patent: Aug. 29, 2023

(54) SOCKET-LOCKER

(71) Applicant: William Lawrence Billups, Jr., Glen Allen, VA (US)

(72) Inventor: William Lawrence Billups, Jr., Glen Allen, VA (US)

( * ) Notice: Subject to any disclaimer, the term of this patent is extended or adjusted under 35 U.S.C. 154(b) by 126 days.

(21) Appl. No.: 17/300,023

(22) Filed: Feb. 12, 2021

(65) Prior Publication Data

US 2021/0237256 A1 Aug. 5, 2021

Related U.S. Application Data

(63) Continuation-in-part of application No. 16/602,273, filed on Sep. 5, 2019, now Pat. No. 10,960,532, which is a continuation-in-part of application No. 16/179,687, filed on Nov. 2, 2018, now Pat. No. 10,493,616, which is a continuation-in-part of application No. 15/046,754, filed on Feb. 18, 2016, now Pat. No. 10,118,287.

(60) Provisional application No. 62/765,364, filed on Sep. 5, 2018, provisional application No. 62/176,412, filed on Feb. 19, 2015.

(51) Int. Cl.

| | |
|---|---|
| ***B25H 3/00*** | (2006.01) |
| ***B25G 1/04*** | (2006.01) |
| ***H01F 7/02*** | (2006.01) |

(52) U.S. Cl.

CPC ..... *B25H 3/003* (2013.01)

(58) Field of Classification Search

CPC ..... A47F 5/0846; A47F 7/0028; B25B 13/06; B25B 13/56; B25H 3/00; B25H 3/003; B25H 3/04; B25H 3/06

USPC ..... 211/69, 69.5, 69.6, 70.6; 206/372, 378

See application file for complete search history.

(56) References Cited

U.S. PATENT DOCUMENTS

| | | | | |
|---|---|---|---|---|
| 5,228,570 A * | 7/1993 | Robinson | B25B 13/56 | 81/177.85 |
| 5,398,823 A * | 3/1995 | Anders | B25H 3/003 | 248/309.2 |
| 5,467,874 A * | 11/1995 | Whitaker | B25H 3/06 | 248/309.2 |
| 5,715,951 A * | 2/1998 | Dembicks | B25B 13/56 | 206/378 |
| 6,386,363 B1 * | 5/2002 | Huang | B25H 3/003 | 206/378 |
| 6,431,373 B1 * | 8/2002 | Blick | B25H 3/003 | 206/378 |
| 6,991,105 B2 * | 1/2006 | Winnard | B25H 3/003 | 206/378 |
| 7,152,747 B2 * | 12/2006 | Wang | A47F 5/0006 | 211/70.6 |

(Continued)

*Primary Examiner* — Joshua E Rodden

(57) ABSTRACT

A socket holder with a built in locking mechanism that is user controlled and activated by a push button which controls internal locking mechanisms which allow this socket holder to securely store and transport sockets mounted to a main socket holder body. This socket holder can hold multiples of sockets to the main socket holder body, releasing them only when desired by the user with the push of the push button that controls the internal mechanisms which release the sockets from the main socket holder body. This socket holder is designed to organize and securely lock the sockets onto the main socket holder body in a way that is dependable and easy to use.

8 Claims, 11 Drawing Sheets

(56) References Cited

U.S. PATENT DOCUMENTS

| | | | | |
|---|---|---|---|---|
| 8,556,075 | B1 * | 10/2013 | Ou | B65D 73/0064<br>206/378 |
| 2005/0221664 | A1 * | 10/2005 | Winnard | B25H 3/003<br>439/510 |
| 2010/0065520 | A1 * | 3/2010 | Hsieh | B25H 3/06<br>211/70.6 |
| 2011/0089126 | A1 * | 4/2011 | Hsieh | B25H 3/06<br>211/70.6 |
| 2012/0061339 | A1 * | 3/2012 | Chang | B65D 73/0064<br>211/70.6 |
| 2014/0260826 | A1 * | 9/2014 | Eggert | B25B 13/06<br>81/177.85 |
| 2016/0096264 | A1 * | 4/2016 | Kao | B25H 3/06<br>206/378 |

* cited by examiner

SOCKET-LOCKER

CROSS REFERENCE TO RELATED APPLICATIONS

This application also claims benefit of provisional application 62/765,364 filed on Sep. 5, 2018.

STATEMENT REGARDING FEDERALLY SPONSORED RESEARCH OR DEVELOPMENT (IF APPLICABLE)

"Not Applicable"

REFERENCE TO SEQUENCE LISTING, A TABLE, OR A COMPUTER PROGRAM LISTING COMPACT DISC APPENDIX (IF APPLICABLE)

"Not Applicable"

BACKGROUND OF THE INVENTION

The field of endeavor being discussed relates to tools and equipment that use "sockets" such as mechanics sockets in automobile repairs, aircraft and machinery. Even more particular to the actual "holders of these sockets".

The "socket holder" being very important as these sockets come in a multiple of different sizes and a multiple of different connecting drive sizes. This makes the need for a reliable holder with this new locking mechanism a feature and a necessity that has not been previously there for the user and the lack of it not being there the cause of much frustration, confusion and wasted time looking for these many different sockets while working on jobs requiring use of these sockets.

With many different size sockets with their different drive sizes not being kept in decent order with a serum and reliable way has been the reason for much confusion and wasted time. (Example) ¼" ⅜" ½" ¾" 1" and above drive sizes for sockets, with each size drive of a socket having many working size ends that go onto each set. This is why it is very important to have a secure, easy to use socket holder with designated spaces for each socket on a lockable socket storage holder device.

Again the background of the invention comes from the need of: NOT having a strong and secure way to easily lock mount and dismount tool sockets onto a socket holder in a reliable, easy to use kind of way for use and transport of said sockets.

In the past the previous way of carrying these tool sockets for many people was to just put them in a box or a bag, making these sockets very hard to access easily and quickly, and causing great frustration for many when looking for said sockets when they were needed on any particular job where a socket or a multiple of different size sockets was needed.

For the most part it seemed the only time a set of sockets was in order and easy to find was when they just came in the box or in the shipping container from the manufacturer of these said sockets.

Using this secure and lockable socket holder device will maintain these sockets in their organized holding spaces on the socket holder dependably.

Keeping these different size drive and sized sockets in their respective holder spaces securely and dependably according to their ascending or descending size order will enable quick and easy access to them when they needed.

BRIEF SUMMARY OF THE INVENTION

The invention claimed is named as the Socket-Locker and is a socket holder designed to securely hold and transport a multiple amount of various sized sockets with various sized drives on its main socket holder body, which can be made or formed out of any hard resin or suitable desired material such as steel, brass, aluminum etc.

The main feature of the Socket-Locker socket holder is an ability to hold sockets onto a main socket holder body where the individual socket holder spaces have internal mechanisms that give the user access to control all of the socket locking balls by use of a push button on the main socket holders outer body while various internal parts working together create strong and reliable controlled socket holding and releasing actions to sockets being placed on each of the individual socket holder mountings, allowing sockets to only be placed on or off of the individual socket holder mountings when the user presses the push button control.

Sockets will always be organized and ready for work when they are needed with this dependable and easy to use Socket-Locker socket holder.

PARTS LIST

Figure 1:
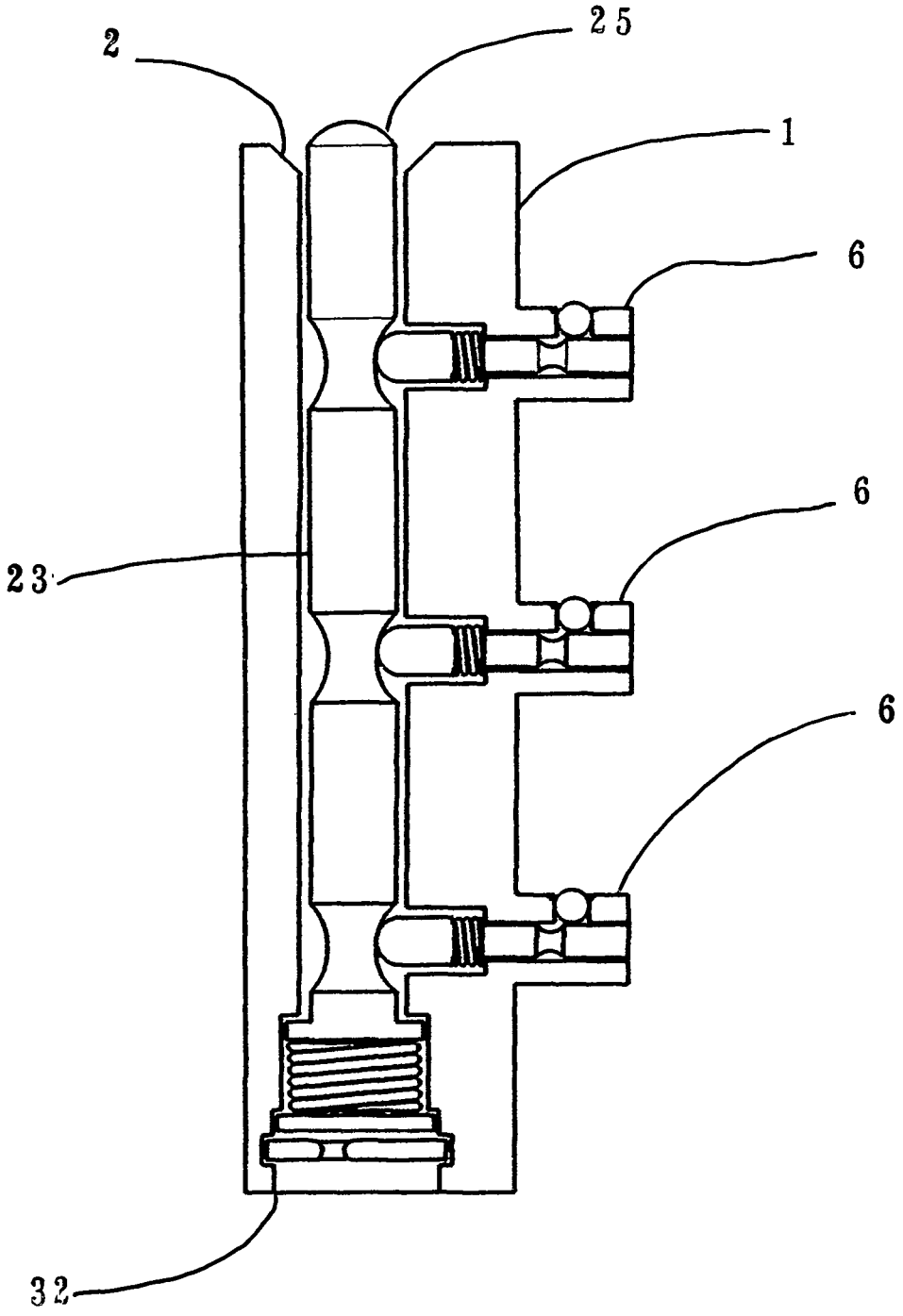
FIG. 1 Shows the internal views of the main socket holder body (1) with the recessed push button end of main release control rod (25) recessed push button opening on main socket holder body (2) main release control rod (23) individual socket holder mountings (6) opening in main body to install main release control rod (32).
Figure 2:
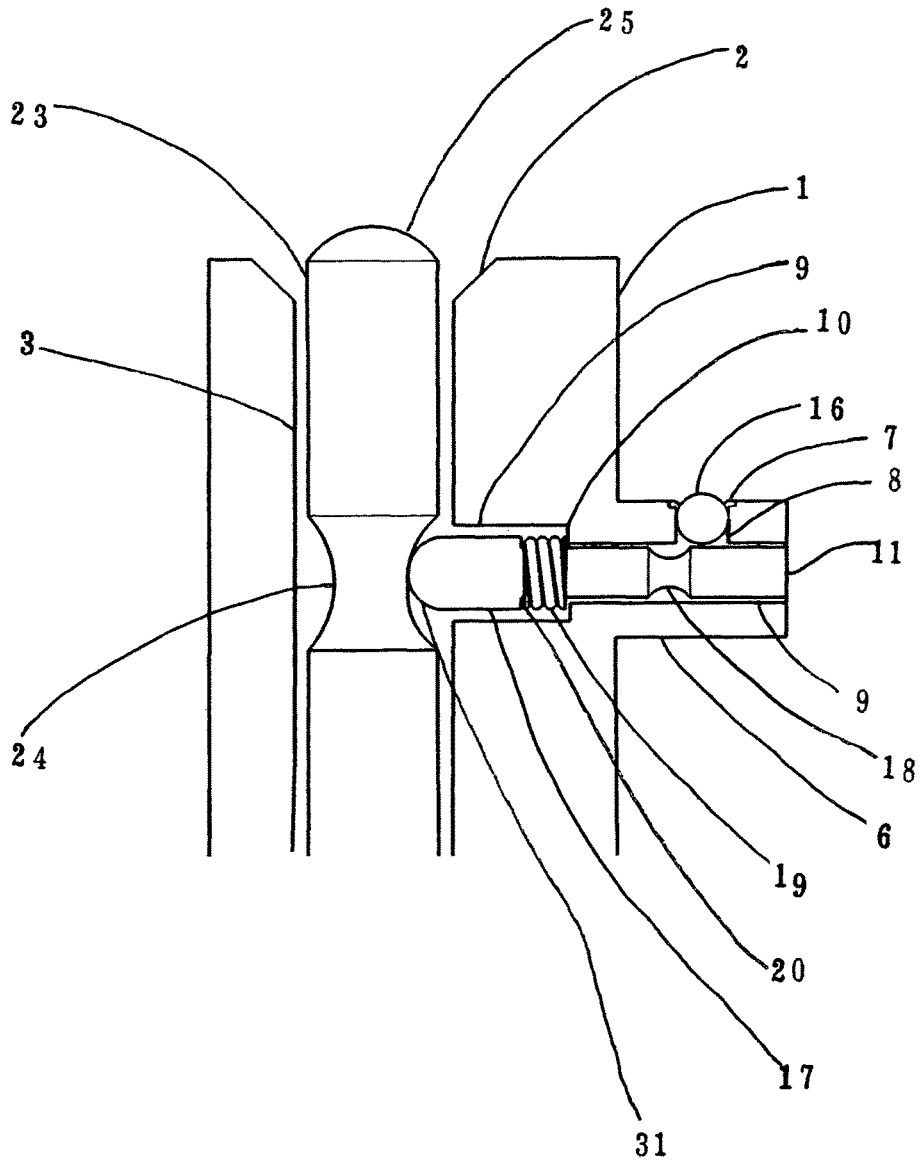
FIG. 2 Shows internal split view of upper end of the main socket holder body (1) with recessed push button opening on main socket holder body (2) main release control rod slot (3) individual socket holder mountings (6) crimp (7) socket locking ball hole (8) push rod guide hole (9) push rod stop notch on main body (10) push rod relief hole (11) socket locking ball hole (16) push rod (17) push rod socket locking ball intersect notch (18) push rod spring (19) push rod spring notch stop (20) main release control rod (23) main release control rod intersect notches (24) recessed push button end of main release control rod (25) rounded end of push rod (31).
Figure 3:
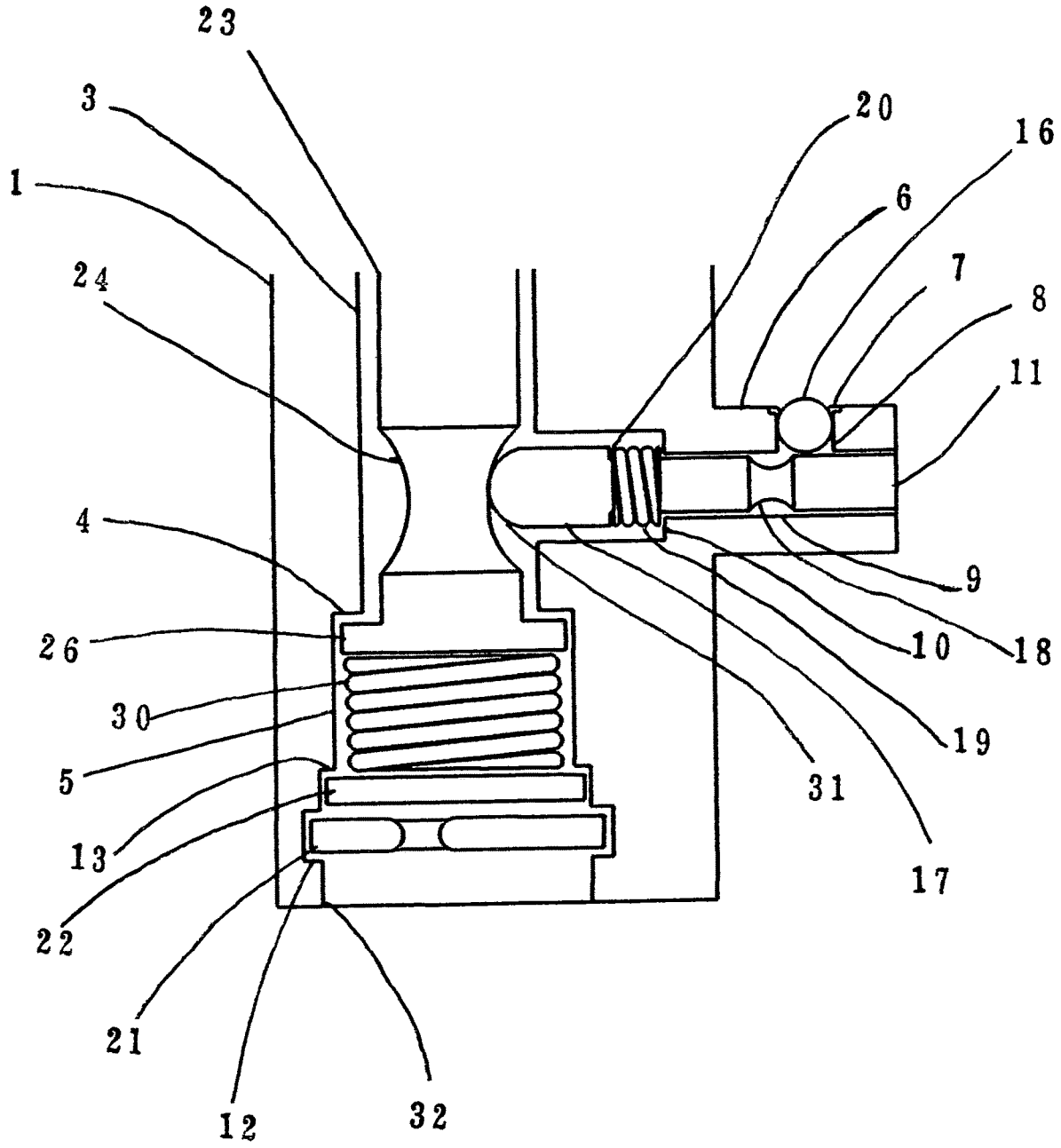
FIG. 3 Shows internal split view of lower end of the main socket holder body (1) with main release control rod slot (3) main release control rod inward stop notch on main body (4) main spring holder position (5) individual socket holder mountings (6) crimp (7) socket locking ball hole (8) push rod guide hole (9) push rod stop notch on main body (10) push rod relief hole (11) lock ring cutout (12) lock plate position mount notch (13) socket locking ball (16) push rod (17) push rod socket locking ball intersect notch (18) push rod spring (19) push rod spring notch stop (20) lock ring (21) lock plate (22) main release control rod (23) main release control rod intersect notches (24) enlarged stop end of main release control rod (26) main spring (30) rounded end of push rod (31) opening in main body to install main release control rod (32).
Figure 4:
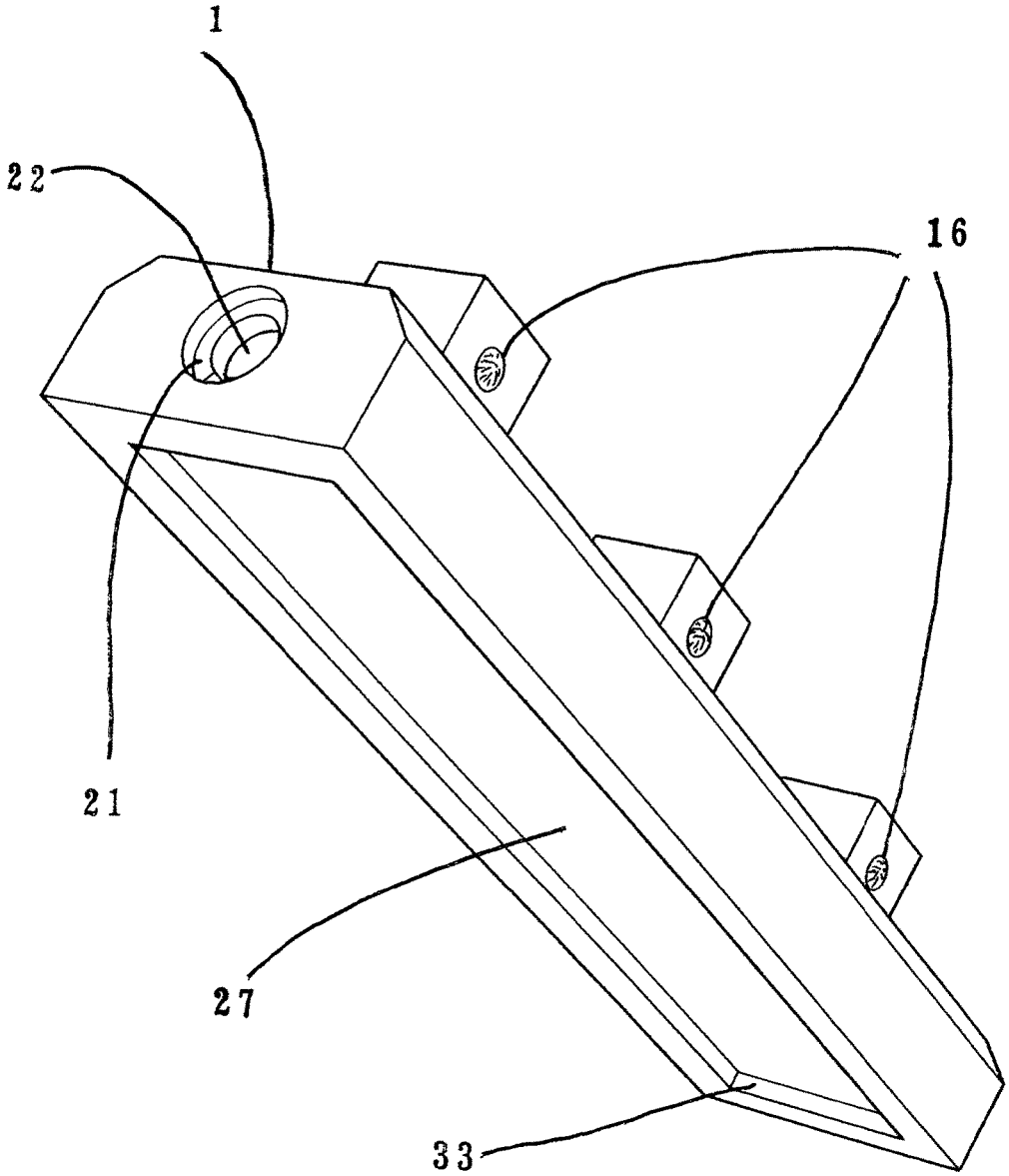
FIG. 4 Shows a perspective view of the main socket holder body (1) with socket locking ball (16) lock ring (21) lock plate (22) and the back plate (27) in a recessed cutout for back plate (33).
Figure 5:
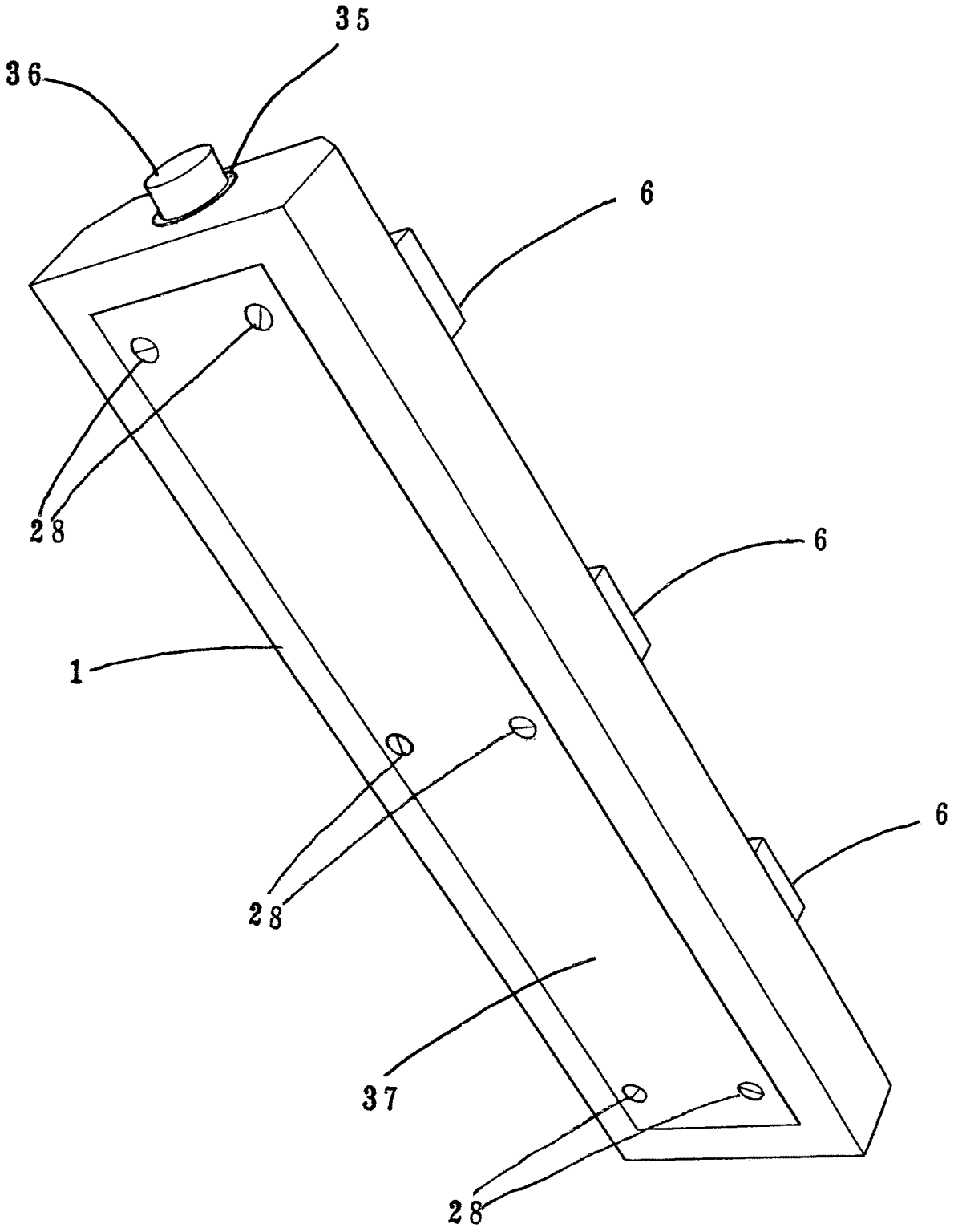
FIG. 5 Shows a perspective view mainly of the backside the main socket holder body (1) with individual socket holder mountings (6) and back plate screws (28) and the exposed push button opening on main socket holder body (35) with the exposed push button end of main release control rod (36) and back plate with screw holes (37).
Figure 6:
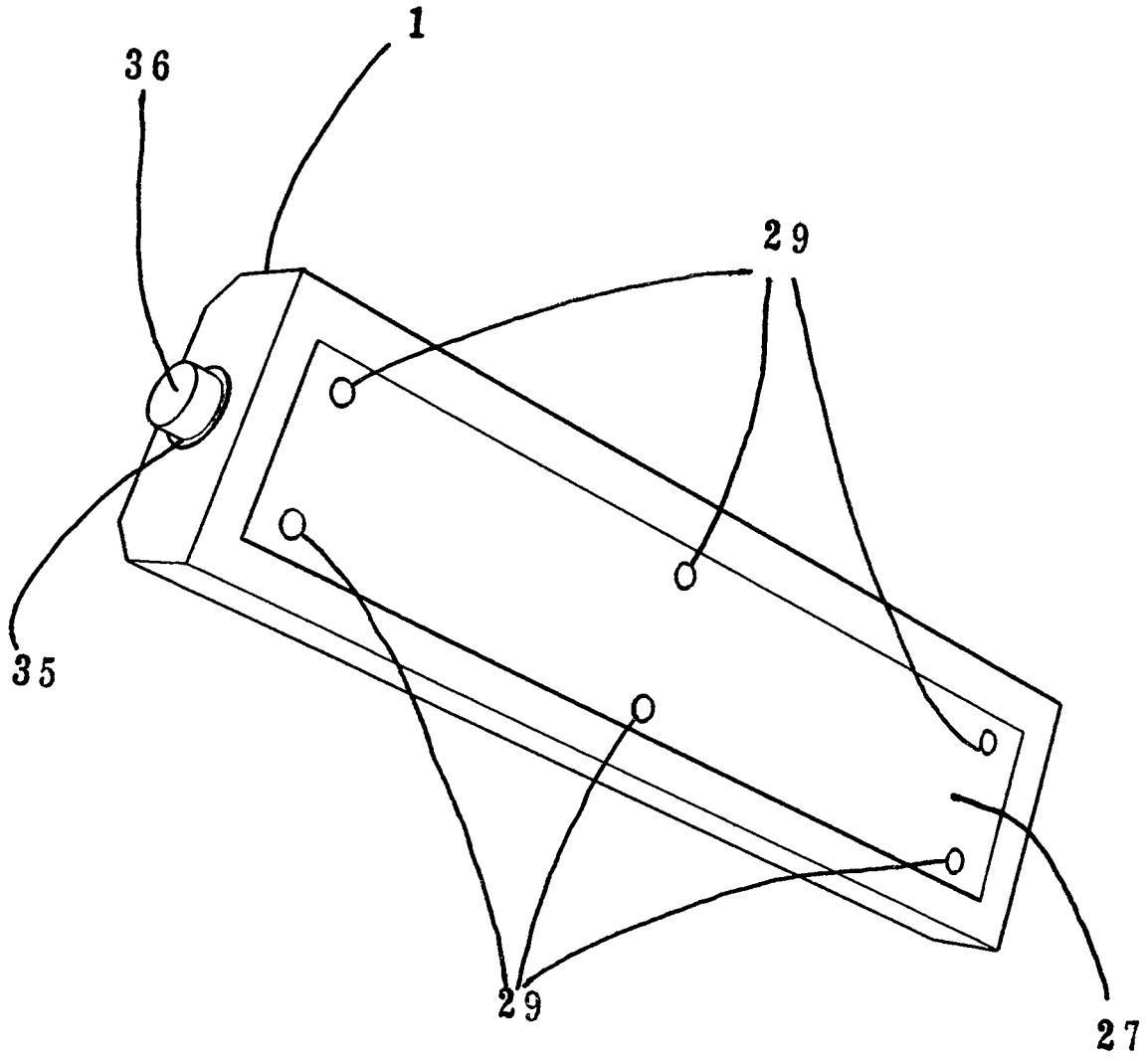
FIG. 6 Shows a perspective view of the main socket holder body (1) back plate (27) back plate holes for screws (29) exposed push button opening on main socket holder body (35) exposed push button end of main release control rod (36).
Figure 7:
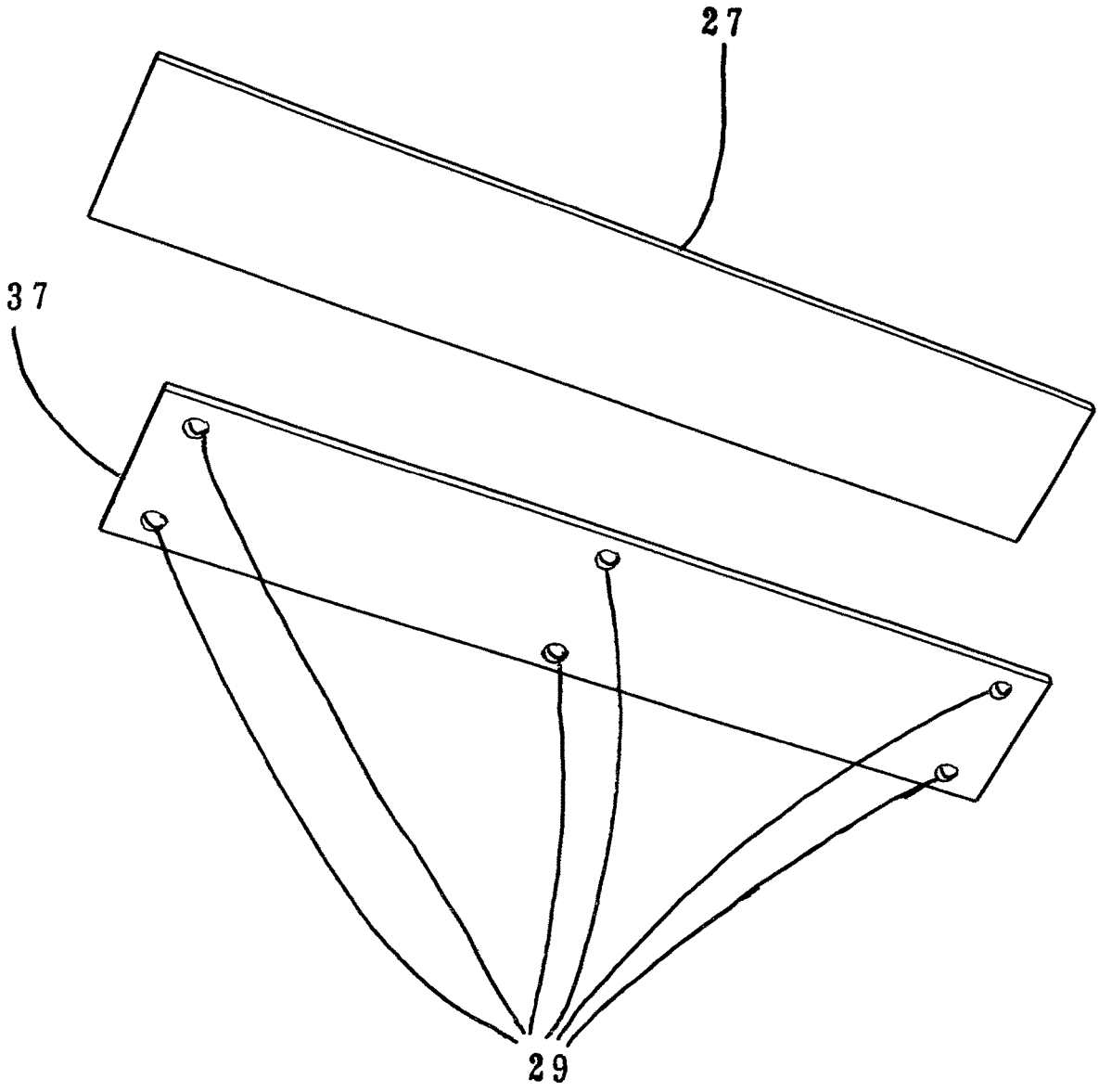
FIG. 7 Shows back plate (27) back plate holes for screws (29) back plate with screw holes (37).
Figure 8:
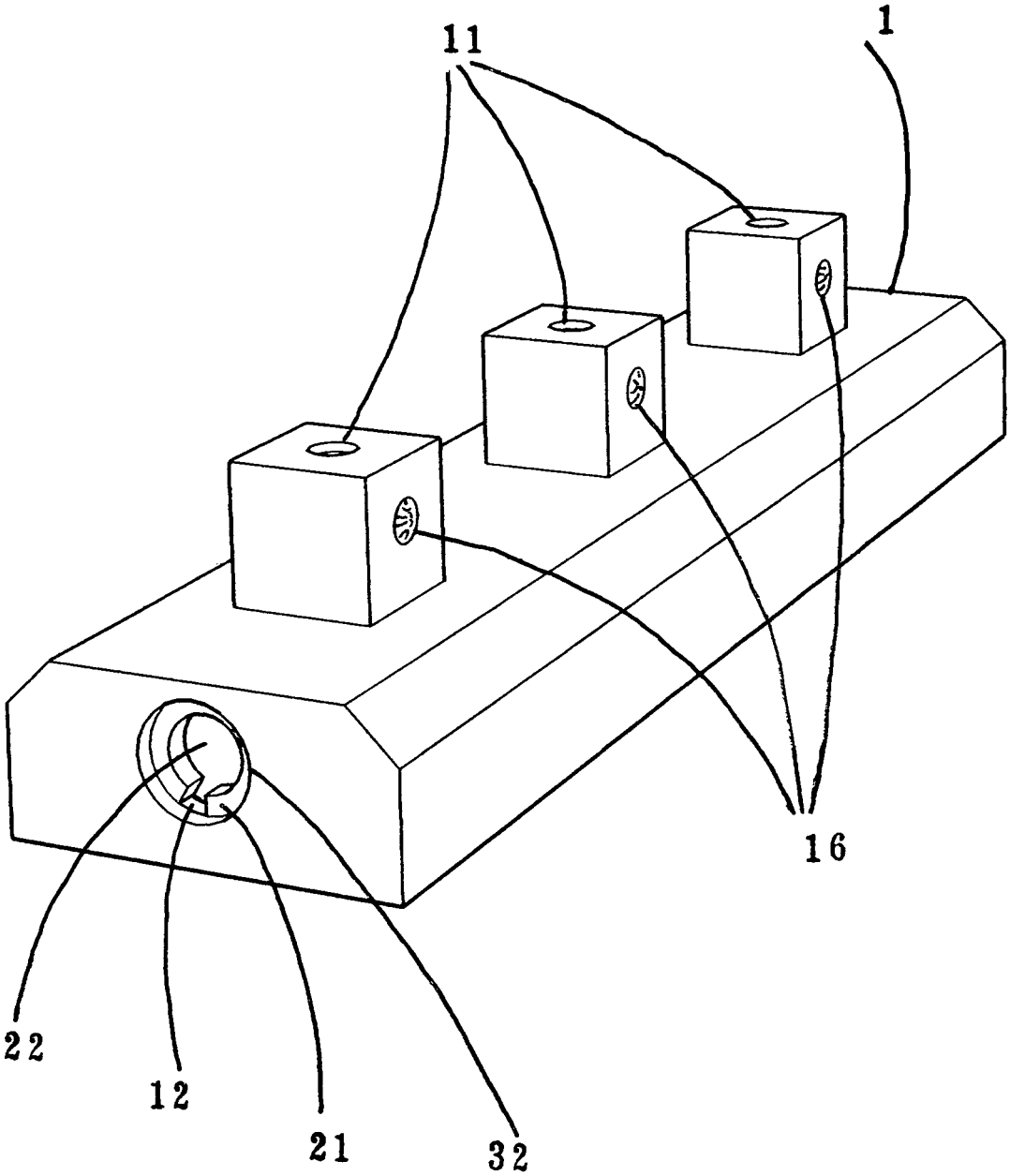
FIG. 8 Shows a perspective view of the main socket holder body (1) push rod relief hole (11) lock ring cutout (12) socket locking ball (16) lock ring (21) lock plate (22) opening in main body to install main release control rod (32).
Figure 9:
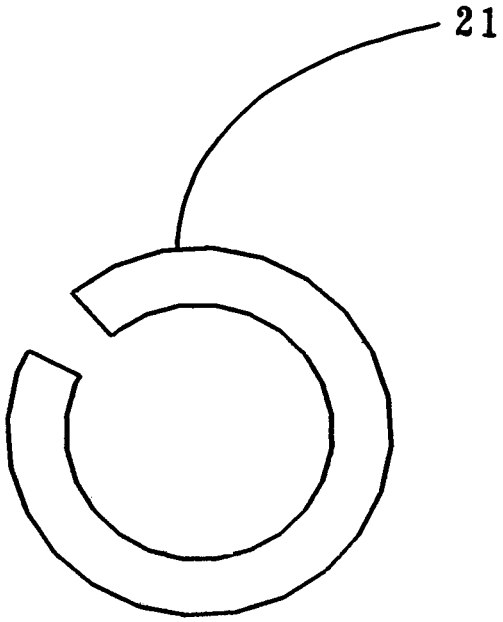
FIG. 9 Shows lock ring (21).
Figure 10:
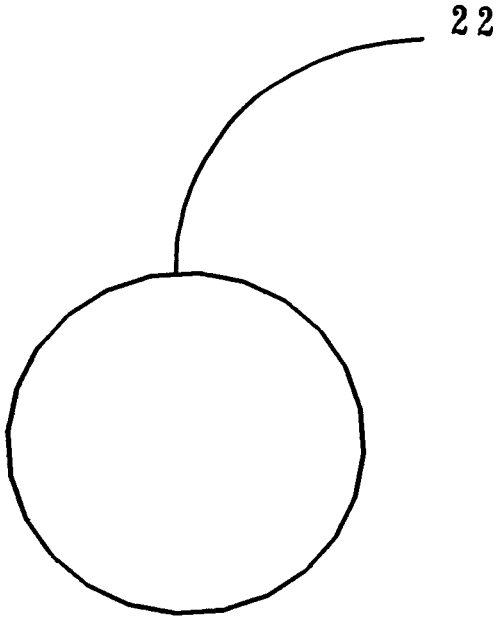
FIG. 10 Shows lock plate (22).
Figure 11:
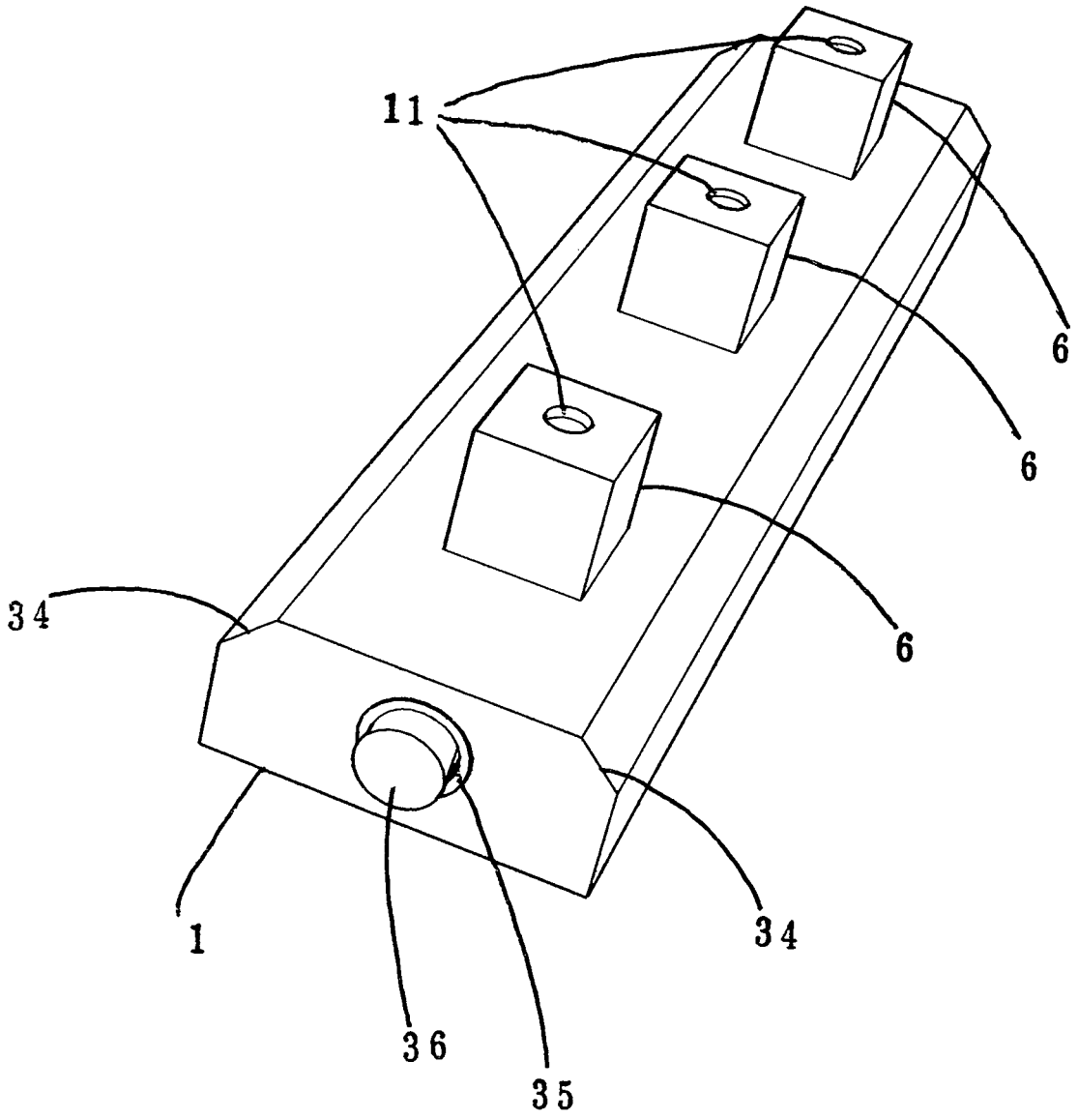
FIG. 11 Shows a perspective view of the main socket holder body (1) individual socket holder mountings (6) push rod relief hole (11) plurality of angles (34) exposed push button opening on main socket holder body (35) exposed push button end of main release control rod (36).

1. main socket holder body
2. recessed push button opening on main socket holder body
3 main release control rod slot
4. main release control rod inward stop notch on main body
5. main spring holder position
6. individual socket holder mountings
7. crimp
8. socket locking ball hole
9. push rod guide hole
10. push rod stop notch on main body
11. push rod relief hole
12. lock ring cutout
13. lock plate position mount notch
14. back plate screw holes in main body
15. adhesive glue
16. socket locking ball
17. push rod
18. push rod socket locking ball intersect notch
19. push rod spring
20. push rod spring notch stop
21. lock ring
22. lock plate
23. main release control rod
24. main release control rod intersect notches
25. recessed push button end of main release control rod
26. enlarged stop end of main release control rod
27. back plate
28. back plate screws
29. back plate holes for screws
30 main spring
31. rounded end of push rod
32. opening in main body to install main release control rod
33. recessed cutout for back plate
34. plurality of angles
35. exposed push button opening on main socket holder body
36. exposed push button end of main release control rod
37. back plate with screw holes
38. socket size markings of sae and metric

DETAILED DESCRIPTION OF THE INVENTION

The detailed description of the tool socket holder is named as the Socket-Locker which has a main socket holder body (1) with a plurality of individual socket holder mountings (6) that have a one of the ends of the main release control rod (23) serving as a push button control for the socket locking ball (16) which is allowed to move back and fourth in the socket locking ball hole (8) of the individual socket holder mountings (6) without falling out of the socket locking ball hole (8) by placement of a crimp (7) on the outside edge of the socket locking ball hole (8).

This socket locking ball hole (8) intersects with a push rod guide hole (9) internally in the individual socket holder mountings (6) that all have a push rod (17) in them with a push rod socket locking ball intersect notch (18) also placed on the push rod (17) which moves back and fourth in the push rod guide hole (9) as the push rod (17) moves the push rod socket locking ball intersect notch (18) into an alignment with the socket locking ball hole (8) which also creates a needed space for the socket locking ball (16) to partially drop into the push rod guide hole (9) from the socket locking ball hole (8) which allows for sockets to be placed on or removed from the individual socket holder mountings (6) on the main socket holder body (1).

As the main release control rod (23) in the main release control rod slot (3) has main release control rod intersect notches (24) which meet the push rod (17) at the rounded end of push rod (31) which said push rod (17) also having a push rod spring notch stop (20) with a push rod spring (19) mounted onto each of the push rods (17) which holds the push rod spring (19) in set place on the push rod (17) as movement is being made with the push rod (17) as movement is compressing the push rod spring (19) against the push rod stop notch on main body (10) creating compression force and allowing for movement space also for the push rod (17) to move into the push rod guide hole (9) creating alignments with the socket locking ball hole (8) so the socket locking ball (16) can again drop partially into the push rod socket locking ball intersect notch (18) in the push rod guide hole (9) while the end of the push rod (17) has movement relief space from the push rod relief hole (11).

The main release control rod (23) by being pressed at either the recessed push button end of the main release control rod (25) located at the recessed push button opening on main socket holder body (2) or the exposed push button end of main release control rod (36) located at the exposed push button opening on main socket holder body (35) depending on which main socket holder body (1) push button end design is being used as the main release control rod (23) end as push button controlled presses move the main release control rod (23) along down inside of the main release control rod slot (3) allowing for the main release control rod intersect notches (24) to contact and interact with the push rods (17) to move the push rods (17) as the main release control rod (23) is moveable while also working to hold push rods (17) still also as in keeping the socket locking ball (16) in the out position which will hold sockets onto the on the individual socket holder mountings (6) when the main release control rod is not being pressed and will let the socket locking ball (16) move inwardly into the socket locking ball hole (16) on the individual socket holder mountings (6) as the main release control rod (23) gets action to cause movements from being pressed down at main release control rod (23) control end by user pressing down which cause movements of the push the push rod (17) as proper alignment positions are forming with moving internal parts working together to control movements and interactions with the socket locking ball (16) also there is always some light compression force against the push rod spring (19) placed on the push rod (17) as this light compression force holds the push rod (17) against the main release control rod (23) at all times and will when moved create even more compression force that will return the push rod (17) back into original light compression force of holding positions against the push rods (17) of keeping contact with the main release control rod (23) at the main release control rod intersect notches (24).

The opening in main body to install main release control rod (32) after said main release control rod (23) is installed the enlarged stop end of main release control rod (26) comes to designated place where inward movement into the main socket holder body (1) is stopped by placement of the main release control rod inward stop notch on main body (4) which also is where the main spring holder position (5) which also has a main spring (30) placed there and then there is a lock plate position mount notch (13) that has a lock plate (22) placed there and then a lock ring cutout (12) that has a lock ring (21) placed in to keep parts in place while allowing for the enlarged stop end of main release control rod (26) to have movement space to then compress the main spring (30) and also allows for movement room of entire said main release control rod (23) as movements happen after push button end of the main release control rod (23) is being pressed by user while also generating compression force on the main spring (30) which will be also be used again to lift the main release control rod back up after having been pressed down against the main spring (30) while also keeping a steady light fixed pressure force on the main release control rod (23) after being pressed down which is used to keep the main release control rod lifted up into the main socket holder body (1) at the ready position when not being pressed down allowing for alignment positions with all moving internal parts and keeping push rod (17) in their original positions with the main release control rod (23).

The main socket holder body (1) can have a plurality of angles (34) having the socket size markings of sae and metric (38) placed next to the individual socket holder mountings (6) allowing for precise placement of sockets back onto the main socket holder body (1) after being removed from the main socket holder body.

The main socket holder body (1) can have a back plate (27) attached with an adhesive glue (15) into the recessed cutout for back plate (33) or have a back plate with screw holes (37) mounted into the back plate screw holes in main body (14) with back plate screws (28) going through the back plate holes for screws (29) for installation purposes along with any adhesive glue (15) resins if desired to help seal the back plate with screw holes (37) also or the back plate (27) without any back plate holes for screws (29) as either back plate (27) can be mounted on to the back of the main socket holder body (1).

The recessed cutout for back plate (33) on the main socket holder body (1) for mounting back plate (27) can be placed as shallow or deep as desired on the back of the main socket holder body (1) allowing for a flush mounted back plate (27) or a little deeper recessed back plate (27)

Also the main socket holder body (1) can be made to any length desired with as many individual socket holder mountings (6) on individual columns of the socket holder mountings (6) while the main socket holder body (1) can also be made to have multiple columns of individual socket holder mountings (6) placed on multiple columns of said main socket holder body (1) which columns also can have various size socket drives on each column of the individual socket holder mountings (6) or different size socket drives on different columns of multiple column said main socket holder body (1) with example of different size socket drives being ¼", ⅜", ½", ¾", 1", etc. drives sizes.

All parts working together allow for user to easily mount or dismount sockets which are being held onto the main socket holder body (1) while also holding these sockets mounted on the individual socket holder mountings (6) in a strong and secure way.

The invention claimed is:

1. An apparatus for holding and releasing tools having socket drive connection fittings comprising: a main socket holder body (1) with a plurality of individual socket holder mountings (6) each having a socket locking ball (16) placed in a socket locking ball hole (8) that has a crimp (7) placed on outer edge that allows the socket locking ball (16) to have outward movement motion set by placement of the crimp (7) which also prevents the socket locking ball (16) from falling out of the socket locking ball hole (8) which also intersects with a push rod guide hole (9) inside of the individual socket holder mountings (6) that also have a push rod relief hole (11) that allow a push rod (17) to have more space to move as the push rod (17) is moving into position to line up a push rod socket locking ball intersect notch (18) with the socket locking ball (16) inside the socket locking ball hole (8) which when both are aligned allows for the socket locking ball (16) to partially go into the push rod guide hole (9) to allow necessary position changes to the socket locking ball (16) in the socket locking ball hole (8) creating socket hold or release actions to happen with the socket locking ball (16) that is configured to be used on sockets being placed on to be held or taken off the individual socket holder mountings (6) which are on the main socket holder body (1) all depending on where the push rod (17) with the push rod socket locking ball intersect notch (18) is positioned at inside of the push rod guide hole (9) while being configured to be moved back and forth in the push rod guide hole (9) by controlled movement forces made against the push rod (17) configured to be created by a user pressing an exposed push button end of a main release control rod (25) which is one end of a main release control rod (23) that also is exposed externally on the main socket holder body (1) for controlled usage through an exposed push button opening on the main socket holder body (1) which also connects to a main release control rod slot (3) inside the main socket holder body (1) where the main release control rod (23) travels and has movement space inside of the main socket holder body (1) while on another opposite end of the main release control rod (23) there is an enlarged stop end of the main release control rod (26) which sets inward movement limit of the main release control rod (23) as contact is made with a main release control rod inward stop notch on the main socket holder body (4) near an opening in the main socket holder body to install the main release control rod (23) where the enlarged stop end of the main release control rod (26) makes contact with a main spring (30) in a main spring holder position (5) which is in rest and compresses against a lock plate (22) set in a lock plate position mount notch (13) which is held into place with a lock ring (21) placed into a lock ring cutout (12) near the opening in the main socket holder body to install the main release control rod (23) creating needed space that allows for the main release control rod (23) to have movement with and against and while compressing the main spring (30) creating force configured to push the main release control rod (23) back to an original position as before compressing of the main spring (30) happened by the user pressing down the exposed push button end of the main release control rod (25) depending on if the exposed push button end of main release control rod (25) is being pressed or is being released when the exposed push button end of the main release control rod (25) is released and does also go back through the exposed push button opening on the main socket holder body (1) while the main release control rod (23) also moves along inside the main release control rod slot (3) allowing the main release control rod (23) that has a plurality of a main release control rod intersect notches (24) to line up with and meet all of the push rod guide holes (9) which have said push rod (17) placed in them having a rounded end of the push rod (31) which does also line up with and makes contact with the main release control rod (23) at the main release control rod intersect notches (24) which control the push rod (17) movements depending on where the main release control rod intersect notches (24) are at internally as the main release control rod (23) is being moved by the user at the exposed push button end of main release control rod (25) and also on the push rod (17) there is a push rod spring (19) mounted onto the push rod (17) that mounts up next to a push rod spring notch stop (20) that holds the push rod spring (19) in set holding place position on the push rod (17) which makes the push rod spring (19) move also as the push rod (17) is being moved and going against and into a push rod stop notch on main body (10) located inside of the push rod guide hole (9) which compresses the push rod spring (19) being compressed there and also creates movement space for the push rod (17) to be moved back and forth inside of the push rod guide hole (9) from movement coming from the main release control rod (23) is being created by the user as they are pressing down on the exposed push button end of the main release control rod (25) which movements when combined make the push rod socket locking ball intersect notch (18) go in and out of alignment with the socket locking ball hole (8) which allows the user to have control of all of the socket locking balls (16) to partially drop into the push rod guide holes (9) while the push rod outer end (17) also has some movement room space also to move out of the push rod relief hole (11) opening partially if needed and this allows for any socket to be easily placed on or off of the individual socket holder mountings (6) which are on the main socket holder body (1) while compression force generated on the push rod spring (19) is also used to return all said push rods (17) back into their original contact positions with the main release control rod intersect notches (24) located on the main release control rod (23) as the main release control rod (23) moves along also internally in the main release control rod slot (3) as the enlarged stop end of the main release control rod (26) also has designated space to move back and forth in between the main release control rod inward stop notch on main body (4) and the lock plate (22) in which space is placed the main spring (30) in the main spring holder position (5) which compresses and makes movement space for the enlarged stop end of the main release control rod (26) when moving and being pressed against the main spring (30) by the user of the exposed push button end of the main release control rod (25) which creates compression which will be used also to push the main release control rod (23) back into original socket holding ready position by applying lifting force as needed to hold and keep the main release control rod (23) in original upward ready position place in the main socket holder body (1) as well as keeping the socket locking ball (16) locked in an outward position in the socket locking ball hole (8) is original place for the socket locking ball (16) which is position used for holding sockets on to their designated size and space positions while being locked onto the individual socket holder mountings (6) that are on the main socket holder body (1) as a back plate (27) is configured to be mounted on back of the main socket holder body (1) in a recessed cutout for back plate (33) by an adhesive glue (15).

2. An apparatus for holding and releasing tools having socket drive connection fittings comprising: a main socket holder body (1) with a plurality of individual socket holder mountings (6) each having a socket locking ball (16) placed in a socket locking ball hole (8) that has a crimp (7) placed on outer edge that allows the socket locking ball (16) to have outward movement motion set by placement of the crimp (7) which also prevents the socket locking ball (16) from falling out of the socket locking ball hole (8) which also intersects with a push rod guide hole (9) inside of the individual socket holder mountings (6) that also have a push rod relief hole (11) that allow a push rod (17) to have more space to move as the push rod (17) is moving into position to line up a push rod socket locking ball intersect notch (18) with the socket locking ball (16) inside the socket locking ball hole (8) which when both are aligned allows for the socket locking ball (16) to partially go into the push rod guide hole (9) to allow necessary position changes to the socket locking ball (16) in the socket locking ball hole (8) creating socket hold or release actions to happen with the socket locking ball (16) that is configured to be used on sockets being placed on to be held or taken off the individual socket holder mountings (6) which are on the main socket holder body (1) all depending on where the push rod (17) with the push rod socket locking ball intersect notch (18) is positioned at inside of the push rod guide hole (9) while being configured to be moved back and forth in the push rod guide hole (9) by controlled movement forces made against the push rod (17) configured to be created by a user pressing a recessed push button end of a main release control rod (25) which is one end of a main release control rod (23) that also is on the main socket holder body (1) for controlled usage through a recessed push button opening on the main socket holder body (2) which also connects to a main release control rod slot (3) inside the main socket holder body (1) where the main release control rod (23) travels and has movement space inside of the main socket holder body (1) while on another opposite end of the main release control rod (23) there is an enlarged stop end of main release control rod (26) which sets inward movement limit of the main release control rod (23) as contact is made with a main release control rod inward stop notch on main body (4) near an opening in the main socket holder body to install the main release control rod (23) where the enlarged stop end of main release control rod (26) makes contact with a main spring (30) in a main spring holder position (5) which is in rest and compresses against a lock plate (22) set in a lock plate position mount notch (13) which is held into place with a lock ring (21) placed into a lock ring cutout (12) near the opening in the main socket holder body to install the main release control rod (23) creating needed space that allows for the main release control rod (23) to have movement with and against and while compressing the main spring (30) creating force configured to push the main release control rod (23) back to an original position as before compressing of the main spring (30) happened by the user pressing down the exposed push button end of the main release control rod (25) depending on if the recessed push button end of main release control rod (25) is being pressed or is being released when the recessed push button end of the main release control rod (25) is released and does also go back through the recessed push button opening on the main socket holder body (2) while the main release control rod (23) also moves along inside the main release control rod slot (3) allowing the main release control rod (23) that has a plurality of main release control rod intersect notches (24) to line up with and meet all of the push rod guide holes (9) which have said push rod (17) placed in them having a rounded end of push rod (31) which does also line up with and makes contact with the main release control rod (23) at the main release control rod intersect notches (24) which control the push rod (17) movements depending on where the main release control rod intersect notches (24) are at internally as the main release control rod (23) is being moved by the user at the recessed push button end of the main release control rod (25) and also on the push rod (17) there is a push rod spring (19) mounted onto the push rod (17) that mounts up next to a push rod spring notch stop (20) that holds the push rod spring (19) in set holding place position on the push rod (17) which makes the push rod spring (19) move also as the push rod (17) is being moved and going against and into a push rod stop notch on main body (10) located inside of the push rod guide hole (9) which compresses the push rod spring (19) being compressed there and also creates movement space for the push rod (17) to be moved back and forth inside of the push rod guide hole (9) from movement coming from the main release control rod (23) is being created by the user as they are pressing down on the recessed push button end of the main release control rod (25) which movements when combined make the push rod socket locking ball intersect notch (18) go in and out of alignment with the socket locking ball hole (8) which allows user to have control of all of the socket locking balls (16) to partially drop into the push rod guide hole (9) while the push rod outer end (17) also has some movement room space also to move out of the push rod relief hole (11) opening partially if needed and this allows for any socket to be easily placed on or off of the individual socket holder mountings (6) which are on the main socket holder body (1) while compression force generated on the push rod spring (19) is also used to return all said push rods (17) back into their original contact positions with the main release control rod intersect notches (24) located on the main release control rod (23) as the main release control rod (23) moves along also internally in the main release control rod slot (3) as the enlarged stop end of the main release control rod (26) also has designated space to move back and forth in between the main release control rod inward stop notch on main body (4) and the lock plate (22) in which space is placed the main spring (30) in the main spring holder position (5) which compresses and makes movement space for the enlarged stop end of the main release control rod (26) when moving and being pressed against the main spring (30) by the user of the recessed push button end of the main release control rod (2) which creates compression which will be used also to push the main release, control rod (23) back into an original socket holding ready position by applying lifting force as needed to hold and keep the main release control rod (23) in original upward ready position place in the main socket holder body (1) as well as by doing this also keeps the socket locking ball (16) locked in an outward position in the socket locking ball hole (8) is original place for the socket locking ball (16) which is position used for holding sockets onto their designated size and space positions while being locked onto the individual socket holder mountings (6) that are on the main socket holder body (1) as a back plate (27) is configured to be mounted on back of the main socket holder body (1) in a recessed cutout for back plate (33) by an adhesive glue (15).

3. The apparatus of claim 1, has on said main socket holder body (1) a plurality of angles (34).

4. The apparatus of claim 3, has on said main socket holder body (1) socket size markings of sae and metric (38) placed on either or both sides of the plurality of angles (34) which are next to each of the individual socket holder mountings (6).

5. The apparatus of claim 1, has placed on said main socket holder body (1) the back plate which has screw holes (29) in which each of the screw holes (29) have back plate screws (28) which go into the back plate screw holes (29).

6. The apparatus of claim 2, has on said main socket holder body (1) a plurality of angles (34).

7. The apparatus of claim 6, has on said main socket holder body (1) socket size markings of sae and metric (38) placed on either or both sides of the plurality of angles (34) which are next to each of the individual socket holder mountings (6).

8. The apparatus of claim 2, has placed on said main socket holder body (1) the back plate which has screw holes (29) in which each of the screw holes (29) have back plate screws (28) which go into the back plate screw holes (29).

* * * * *